United States Patent [19]

Clarke

[11] 4,404,250

[45] Sep. 13, 1983

[54] FIRE-RETARDANT HIGH PRESSURE CONSOLIDATED ARTICLES CONTAINING AN AIR-LAID WEB AND METHOD OF PRODUCING SAME

[75] Inventor: Theodore R. Clarke, Cincinnati, Ohio

[73] Assignee: Formica Corporation, Wayne, N.J.

[21] Appl. No.: 422,041

[22] Filed: Sep. 23, 1982

[51] Int. Cl.[3] ..... D04H 1/58

[52] U.S. Cl. ..... 428/220; 156/62.2; 156/62.4; 156/285; 156/306.6; 428/283; 428/284; 428/286; 428/288; 428/290; 428/526; 428/530; 428/531; 428/921

[58] Field of Search ..... 428/220, 283, 284, 286, 428/288, 290, 526, 530, 531, 921; 156/285, 306.6, 62.2, 62.4

[56] References Cited

U.S. PATENT DOCUMENTS 4,374,171 2/1983 McCarter ..... 428/921

*Primary Examiner*—Marion McCamish

[57] ABSTRACT

The invention relates to flame-retardant, high pressure consolidated articles containing an air-laid web and to a method of preparing such articles wherein boric acid or ammonium pentaborate is added as a flame-retardant additive.

12 Claims, No Drawings

FIRE-RETARDANT HIGH PRESSURE CONSOLIDATED ARTICLES CONTAINING AN AIR-LAID WEB AND METHOD OF PRODUCING SAME

BACKGROUND OF THE INVENTION

The production of substrates comprising cellulosic fibers and a thermosetting resin composition useful, for example, in supporting decorative layers in the formation of high pressure decorative thermoset plastics laminates is well known. Conventionally, said substrates comprise a plurality, i.e. about 2–10, of paper core sheets impregnated with a liquid thermosetting resin composition, said core sheets being prepared by impregnating a web of paper, prepared by a wet-laying process, with a solution or dispersion of a thermosetting resin composition in a volatile solvent, drying said impregnated web to reduce the volatile matter content to a desired level and cutting said impregnated, dried paper web into sheets of the required dimensions. Sufficient core sheets are normally employed to provide laminates having thicknesses of about 0.25 mm–2.25 mm.

Recently, it has been found that high pressure consolidated articles such as decorative laminates produced from a thermosetting resin containing fibrous cellulosic substrate, wherein the disadvantages of such articles made by conventional sheet processes are overcome or diminished, may be produced by using, as the substrate, an air-laid web comprising both cellulosic fibers and a thermosetting resin. These high pressure articles exhibit a toughness superior to those produced conventionally which contain, as their core, a plurality of thermosetting resin impregnated Kraft paper sheets. This toughness is evidenced by the articles' increased resistance to stress-cracking. Additionally, these pressure articles also exhibit substantially equivalent uniform strength and dimensional properties regardless of the machine direction from which the measurement is taken.

One of the most difficult to solve problems the consolidated article industry has been faced with in recent years is to improve the flame-retardancy of the articles so that they can be used in particular service applications wherein non-flammability is critical such as on ships and naval vessels.

When producing such articles from core materials composed of a plurality of resin impregnated paper sheets, the addition of flame-retardant additives must be accomplished either during the production of the paper sheets per se or during the impregnation of the sheets with resin. To retain the flame-retardant additive in the paper during the paper-making process is extremely difficult and to add the additive during paper sheet impregnation with the resin requires that either the resin be a solvent for the flame-retardant or that the resin bath be continuously agitated to retain the flame-retardant in suspension in the resin bath while the paper is passing therethrough.

SUMMARY OF THE INVENTION

Using air-laid webs as core materials, the incorporation of flame-retardant additives therein so as to provide heat and pressure consolidated articles having sufficient flame-retardancy to pass stringent regulations, has now been accomplished. By the use of particles of boric acid or ammonium pentaborate it has been found that excellent flame-retardant heat and pressure consolidated articles can be produced having low smoke levels without interfering with the basic process steps of the production of the article and without causing scumming of the laminate press plates.

BACKGROUND OF THE INVENTION

The manufacture of air-laid fibrous webs is well-known, and fibrous cellulosic webs useful for producing many diverse products have been manufactured commercially.

Commonly, air-laid fibrous webs are prepared by disintegrating fibrous, cellulosic material into its component fibers, transporting the fibers to a foraminous moving web-forming surface and depositing the fibers thereon to form a layer with the aid of suction applied to the under side of the surface. Usually the fibrous, cellulosic material is disintegrated into its component fibers by a machine such as a hammermill or disc refiner and the fibers are transported to the forming surface in an air-stream. Binder material is commonly applied to or admixed with the fibers as a particulate solid or as a liquid spray and the web deposited therefrom is then consolidated between nip rollers. When the binder is added as a solid to the air-fiber stream, it may be introduced into the hammermill or thereafter, but before deposition on the forming surface. Additionally, when the binder is used as a spray, the sprayed fibers may thereafter be dried and introduced as such into the forming apparatus.

A known apparatus for forming substrates by airlaying cellulosic fibers comprises: (i) an air-swept hammermill wherein cellulosic material is defibrated into its component fibers in an air-stream, (ii) ducting whereby the fiber containing air-stream is conveyed to a distributor, (iii) a distributor such as disclosed in U.S. Pat. No. 3,518,706, comprising a housing having a perforated planar bottom wall and side walls, one or more impellers mounted to rotate about an axis substantially perpendicular to the bottom wall a short distance above and in non-contacting relationship with the upper surface of said bottom wall, inlet means for the fiber containing air-stream to enter the distributor, outlet means whereby fibrous material may be recycled to the hammermill and, optionally, a plate member located above said impellers and extending inwardly from the side walls of the housing so as to form a partition between a lower part and an upper part of said housing, said distributor being positioned so that the bottom wall is cooperatively located above the upper surface of (iv) a moving, foraminous belt upon the upper surface of which the cellulosic fibers are deposited to form a layer with the aid of (v) means for applying suction to the other surface of said belt and (vi) means for compacting the so-deposited cellulosic fiber layer, see U.S. Pat. No. 2,698,271.

DESCRIPTION OF THE INVENTION INCLUDING PREFERRED EMBODIMENTS

When preparing a substrate adapted for use in the production of consolidated articles such as high pressure decorative laminates, the thermosetting resin must be randomly distributed throughout the deposited layer and there must be sufficient of the resin present to provide the desired properties to the heat and pressure consolidated laminate. In the production of the high pressure decorative laminates, the resin content of the substrate lies in the range from about 20% to about 35%, by weight preferably from about 25% to about 30%, based on the total weight of the substrate.

In the formation of an air-laid substrate having uniformity of composition and basis weight and comprising fibers and thermosetting resin, such as by means of an apparatus of the type described above, it is preferable to operate under conditions such that the air has a relative humidity within the range of about 40% to 80%, preferably about 50% to 70%.

If the air employed has a humidity level outside of the disclosed range, then deposition problems may arise in that at too high a humidity clogging of the ducting and screen may occur while at too low a humidity problems may arise due to static electrical charges on the fibers.

In order to impart flame-retardency to the air-laid substrates so that they may be used, when heat and pressure consolidated, as such or as components in, for example, decorative laminates, it has now been found that boric acid or ammonium pentaborate, in particulate form, i.e., particle sizes ranging from about 0.1 micron to 200 microns, may be added along with the fibers, and resin, if the resin is used as a solid. The boric acid and ammonium pentaborate are used in flame-retarding amounts, with the amount of boric acid used generally ranging from about 5.0 to about 25.0 percent, by weight, based on the weight of the fiber, resin and flame-retardant in the core, the amount of ammonium pentaborate generally used ranging from about 4.0 to about 25.0 percent, same basis. A preferred range of either flame-retardant comprises from about 5.0–12.0 percent, same basis.

Boric acid and ammonium pentaborate are known flame-retardants which are normally used in conjunction with other additives such as borates, phosphates etc. They are only slightly soluble in water and therefore cannot be used to impart flame-retarding properties to paper sheets produced by the conventional wet-process and are not very soluble in phenolic resins. They, therefore, cannot be applied to wet-laid paper sheets during their impregnation with resin.

The boric acid or ammonium pentaborate can be added along with the fibers or resin or both, or may be added individually, during the formation of the air-laid web so long as they are uniformly distributed throughout the length and breadth of the web during its formation.

By the method of this invention, there is provided a monostichous substrate comprising a thermosetting resin, flame-retardant and cellulosic fibers which substrate is uniform in composition and basis weight and is of a thickness such that a single ply is useful in the production of such products as heat and pressure consolidated articles.

The thermosetting resin containing monostichous substrate of randomly oriented, substantially non-hydrogen bonded cellulosic fibers is formed using an apparatus of the type described above, by:

(a) feeding fibrous, cellulosic material to an air-swept hammermill and defibrating the material therein to provide cellulosic fibers of an average length of about 0.5 mm to 2.5 mm, preferably about 0.75 mm to 2.0 mm in the presence of humidified air, the relative humidity of which preferably ranges from about 40% to about 80% to thereby form an air-fiber stream;

(b) incorporating into said air-fiber stream from about 20% to about 35%, by weight, of a thermosetting resin, said weight being based on the total weight of resin, in flame-retardant and fiber, and a flame-retarding amount of boric acid or ammonium pentaborate to thereby form an air-fiber-resin flame retardant stream;

(c) passing said air-fiber-resin flame retardant stream to a distributor;

(d) agitating said stream within the distributor by impeller means;

(e) causing said stream to pass through the perforated bottom wall of the distributor;

(f) depositing the fibers, boric acid or ammonium pentaborate and resin onto a moving foraminous belt to form a layer having a thickness of from about 5 mm to about 100 mm, preferably about 10 mm to 80 mm by the operation of the suction means, (g) pre-consolidating the deposited layer to a thickness of from about 0.5 mm to about 10 mm, preferably about 1.0 to about 8.0 mm to form a pre-consoliated layer and (h) heat and pressure consolidating said preconsolidated layer.

The fibrous, cellulosic material employed may comprise any material such as chemical, semi-chemical or mechanical paper pulp, cardboard, linerboard, corrugated box fiber and waste paper and the like, provided that after defibration in the hammermill it comprises fibers of an average length of 0.5 mm to 2.5 mm. Although fibers produced from wood are preferred, fibers produced from straw, grass, bagasse, cotton or synthetics, may be used or in admixture. If the cellulosic material feed is in bulk form, then it is preferred to use a bale-breaker or similar equipment to partially disintegrate the material before it is fed to the hammermill.

The air fed to the hammermill may be humidified to the above-specified extent either internally or externally of the substrate forming apparatus. Thus the apparatus may be sited in a room, the air in which is humidified to the required degree and drawn through the apparatus at the required rate. Alternatively, the air may be drawn into the apparatus and there humidified such as by steam or water spray means to the required level. It is preferred to humidify the air internally of the apparatus as such allows for quicker adjustment of the humidity than is possible with external humidification and further allows the room air to be controlled independently so as to provide more amenable working conditions.

The said thermosetting resin may comprise any thermosetting resin which provides the required properties in the substrate prepared therefrom. The resin may comprise, for example, a one-step or two-step phenol-formaldehyde resin, a melamine-formaldehyde resin, etc. and said resins may contain known extenders, if desried. It is preferred to employ a particulate, thermosetting resin and even more preferred to employ a thermosetting phenol-formaldehyde resin. Such a particulate resin may be prepared by forming a solid, thermosetting resin in bulk or lump form and then grinding or crushing to provide the desired particle size or, more preferably, it may be prepared in particulate form by known emulsion condensation techniques. The mean particle size of the thermosetting resin should range from about 20 microns to about 200 microns, preferably from about 50 to 150 microns.

The thermosettting resin, as well as the flame-retardant powder, may be incorporated into the air-fiber stream by any suitable means and at any suitable position prior to deposition. Thus, the resin and/or flame-retardant may be introduced into the hammermill, into the ducting between the hammermill and the distributor, or into the distributor. Suitable introductory means are known and include spraying means, gate-valves, vibratory-and-screw-feeders etc. It is preferred to employ screw feeders which employ a positive feed principle and can be controlled more precisely to give the feed rate of resin and/or flame-retardant desired.

The air-laid layer may be pre-consolidated between platens or nip rollers as may be most convenient and the preconsolidating means may be heated or cooled, if desired. If said means are heated, then the pre-consolidation must be such that while there may be some conversion of a minor amount of the thermosetting resin to the thermost form, a substantial proportion of the resin is still in the thermosetting form after the pre-consolidation operation. The airlaid layer, before pre-consolidation, must be of such a thickness that after heat and pressure consolidation the resultant article will range in thickness from about 0.25 mm to about 2.25 mm. Airlaid webs are thus deposited on the belt, which may be constructed of metal or other material such as plastic, cloth etc.

According to the instant invention, there is also provided a flame-retardant heat and pressure consolidated, high pressure, thermoset decorative laminate comprising, in superimposed relationship:

(I) a thermost resin containing, monostichous substrate of air-laid, randomly oriented, substantially non-hydrogen bonded cellulosic fibers having an average length of 0.5 mm to 2.5 mm, said substrate being from about 0.25 mm to about 2.25 mm thick and containing from about 20% to about 35%, by weight, of resin, based on the total weight of fiber and resin in I and a flame-retarding amount of boric acid or ammonium pentaborate, (II) a thermoset resin impregnated decorative sheet and optionally, (III) a thermoset resin impregnated alpha-cellulose overlay sheet.

In accordance with the instant invention, the method for preparing said thermoset, high pressure, decorative laminates comprises:

(1) forming a laminate assembly comprising, in superimposed relationship:

(A) a monostichous, air-laid substrate of randomly oriented fibers of 0.5–2.5 mm average length, containing from about 20% to about 35%, same basis as above, of a thermosetting resin and a flame-retarding amount of boric acid or ammonium pentaborate and of sufficient thickness to provide, when heat and pressure consolidated, a final thickness of from about 0.25 mm to about 2.25 mm to the resultant laminate, (B) a thermosetting resin impregnated decorative sheet and, optionally, (C) a thermosetting resin impregnated alpha-cellulose overlay sheet; and (2) consolidating said assembly to a unitary thermoset laminate structure by the application of heat and pressure thereto.

The thermosetting resin impregnated decor sheet employed in the present invention may comprise any of those decor sheets known to provide the decorative surface to a decorative laminate and includes decorative woven or non-woven fabrics, colored or printed paper sheets, wood veneer, cork, and the like. The resin may be of any of those known for use in the production of thermoset laminates but it is preferred to use those 'noble' thermosetting resins known for such use and it is most preferred to employ a high quality printed or colored decorative paper sheet impregnated with a thermosetting melamine-formaldehyde resin composition. By 'noble' thermosetting resins is meant those resins which show no appreciable darkening or color change on conversion from the thermosetting to the thermoset state.

When a decorative woven or non-woven fabric sheet or a printed paper sheet is employed, it is preferred to use, in addition thereto, a surfacing overlay sheet known for use in the production of conventional thermoset laminates. More especially, it is preferred to use a light weight, high-quality, unfilled alpha-cellulose paper sheet impregnated with the same kind of thermosetting resin composition as used to impregnate the decorative sheet and, still more preferably, an overlay sheet impregnated with a thermosetting melamine-formaldehyde resin may be employed.

The optional overlay sheet may comprise any of those overlay sheets known to provide a protective, abrasion-resistant surface to decorative laminates. Preferably, these overlay sheets comprise alpha-cellulose paper which is impregnated with a noble thermosetting resin, preferably melamine/formaldehyde, and which become transparent upon heat and pressure consolidation of the laminate assembly.

The heat and pressure consolidation conducted to produce the unitary article or decorative laminate is suitably carried out using that machinery, equipment, pressplates, temperature, pressure and press-time used for preparing decorative thermoset laminates from the conventional impregnated kraft paper core layers. Pressures ranging from about 700 to about 1400 psi and temperatures ranging from about 120° to 150° C., are commonly employed.

The pre-consolidated layer is further consolidated by heat and pressure so that in the resultant article the thickness of the air-laid substrate is reduced by a factor of about two to about ten. More especially, the heat and pressure consolidation is effected so that in the final article, the substrate has a thickness of from about 0.25 mm to about 2.25 mm, as mentioned above.

Further, while it is preferred to prepare laminates comprising a single substrate made in accordance with the invention, a single thermosetting resin impregnated decor sheet and, optionally, a thermosetting resin impregnated alpha-cellulose overlay sheet, the invention is not so limited and also encompasses laminates comprising a substrate produced from more than one monostichous, non-hydrogen bonded, air-laid webs of different thickness, fiber size, fiber type etc., the noble thermosetting resin impregnated decor sheet and, optionally, the noble thermosetting resin impregnated overlay sheet, with the thickness of the multi-layered web falling within the ranges expressed above.

The following examples are set forth for purposes of illustration only and are not to be construed as limitations on the present invention except as set forth in the appended claims. All parts and percentages are by weight unless otherwise specified.

EXAMPLES 1–14

Defibrated kraft fibers are mixed with powdered phenol/formaldehyde resin and boric acid powder and formed onto a stationary screen with the aid of suction applied to the underside of said screen. The deposited fiber-resin-boric acid layer is preconsolidated, at a pressure of 2300 psi, to a thickness of about 2.25 mm and contains the specified amount of boric acid.

After conditioning the compacted, monostichous, fiber-resin-boric acid core layer at 60% relative humidity for 24 hours, a decorative thermoset resinous laminate assembly is formed comprising:

(a) the above monostichous core layer, (b) a printed decor paper impregnated with a thermosetting melamine/formaldehyde resin to a resin content of about 40% and, (c) an alpha-cellulose overlay sheet impregnated with a thermosetting melamine/formaldehyde resin to a resin content of about 60%.

After positioning between separating sheets, the assembly is heat and pressure consolidated at 1400 psi and 145° C. to a unitary thermoset decorative laminate with a thickness of about 1.12 mm. The resultant laminate is then subjected to a series of tests to determine its flame-retardant properties. The results are set forth in Table I, below, in addition to results using other known flame-retardant additives and fibers.

To be considered effective, the flame-retardant should result in a Limiting Oxygen Index (ASTM-D-2863-70) of at least about 42, an Arapahoe Smoke (Arapahoe Chemicals) of less than about 1.7, an ASTM E-84 Smoke of 10 or less and Flame Spread of 20 or less. The Swedish Fire Box (Nordtest Fire 004) results should be Class I.

TABLE I

| Example | Fiber | Flame-Retardant | % | Oxygen Index | Arapahoe Smoke Test | ASTM E = 84* Smoke | ASTM E = 84* Flame Spread | Swedish Fire Box |
|---|---|---|---|---|---|---|---|---|
| 1 | Linerboard | Boric Acid | 12 | 53 | 1.35 | 5/0 | 15/15 | Class I |
| 2 | Corrugated | " | 8 | 60 | — | — | — | Class I |
| 3 | " | " | 7 | 51 | — | — | — | Class I |
| 4C | " | " | 4 | 45 | — | — | — | Class II |
| 5C | " | APP | 10 | 55 | — | — | — | Class I |
| 6C | " | " | 8 | 49 | — | — | — | Class I |
| 7C | Linerboard | " | 10 | 51 | 3.0 | 30/35 | 15/20 | Class I |
| 8C | " | " | 8 | 44 | 3.0 | 35/35 | 20/20 | Class I |
| 9C | " | " | 6 | 43 | 3.0 | 40/30 | 20/20 | Class II |
| 10C | " | DOT | 15 | 43 | 1.1 | 30/0 | 15/20 | Class I |
| 11C | " | " | 10 | 39 | 1.1 | 15/20 | 20/15 | Class II |
| 12C | " | " | 9 | 39 | 1.4 | 15/20 | 20/15 | Class II |
| 13C | " | " | 5 | 37 | 1.2 | — | — | Class II |
| 14C | " | " | 10 | 39 | 0.9 | — | — | Class II |

*2 Test Samples
APP = ammonium polyphosphate
DOT = disodium octaborate tetrahydrite
C = comparative

EXAMPLES 15 and 16 (comparative)

The procedure of Example 1 is again followed except that the overlay and decor paper are eliminated. When (15) boric acid is used at 12% the Oxygen Index is 53, the Arapahoe Smoke is 1.3 and the ASTM E-84 Smoke & Flame Spread are 0/0 and 15/15, respectively.

Replacement of the boric acid with 15% of (16) DOT results in the following: Oxygen Index 42, Aropahoe Smoke 1.6 and ASTM E-84 Smoke & Flame Spread 0/0 and 15/15, respectively. Example 16C, when considered with Example 10C above shows the inconsistency of DOT as a flame-retardant herein. See also Table V, below.

EXAMPLES 17–35

Using various concentrations of boric acid, either linerboard or corrugated kraft fiber and various thermosetting phenolic resins in the procedure of Example 1, the results set forth in Table II, below, are achieved. Plate Scumming refers to the damage done to the press plate during heat and pressure consolidation due to an interaction between the resin and the flame-retardant additive.

TABLE II

| Example | Fiber | Resin In Core Type | Resin In Core % | % Boric Acid | Oxygen Index | Arapahoe Smoke | Plate Scumming |
|---|---|---|---|---|---|---|---|
| 17C | Linerboard | A | 20 | 4.0 | 38 | 1.59 | No |
| 18C | " | A | 27 | 3.1 | 38 | 1.50 | No |
| 19 | " | A | 18 | 7.3 | 48 | 1.60 | No |
| 20 | " | A | 27 | 6.2 | 44 | 1.62 | No |
| 21 | " | A | 21 | 17.1 | 61 | 1.58 | No |
| 22 | " | A | 28 | 12.9 | 56 | 1.77 | No |
| 23 | " | A | 19 | 22.4 | 75 | 1.39 | No |
| 24 | " | A | 25 | 17.2 | 73 | 1.33 | No |
| 25 | " | A | 25 | 5.9 | 44 | 2.15 | No |
| 26 | " | A | 29 | 6.8 | 43 | 1.65 | No |
| 27 | " | A | 30 | 6.9 | 42 | 1.35 | No |
| 28 | " | A | 29 | 5.3 | 42 | 1.85 | No |
| 29 | " | A | 29 | 6.7 | 44 | 1.65 | No |
| 30 | " | A | 29 | 8.0 | 46 | 1.96 | No |
| 31 | " | A | 29 | 6.8 | 44 | 1.75 | No |
| 32C | Corrugated | A | 29 | 3.4 | 38 | 2.22 | No |
| 33 | " | A | 28 | 6.4 | 46 | 1.78 | No |
| 34 | " | A | 27 | 9.4 | 56 | 1.66 | No |

TABLE II-continued

| Example | Fiber | Resin In Core Type | Resin In Core % | % Boric Acid | Oxygen Index | Arapahoe Smoke | Plate Scumming |
|---|---|---|---|---|---|---|---|
| 35 | Linerboard | B | 28 | 6.5 | 43 | 1.39 | No |

A = two-step phenolic resin
B = one-step phenolic resin

EXAMPLES 36–38

Following the procedure of Example 1 except that ammonium pentaborate is substituted for the boric acid therein, the following results, set forth in Table III, are attained:

TABLE III

| Example | Resin In Core Type | Resin In Core % | Ammonium Pentaborate % | Oxygen Index | Arapahoe Smoke | Plate Scumming |
|---|---|---|---|---|---|---|
| 36C | A | 30 | 3.4 | 39 | 1.64 | No |
| 37 | A | 30 | 3.9 | 43 | 1.73 | No |
| 38 | B | 27 | 6.3 | 45 | 1.64 | No |

Type A = two-step phenolic resin
Type B = one-step phenolic resin

EXAMPLES 39–60

(Comparative)

Following the procedure of Example 1 various additional commercially available flame-retardant materials are used as replacements for the boric acid thereof using linerboard kraft fiber and various resins. The results are set forth in Table IV, below.

TABLE IV

| Example | Resin In Core Type | Resin In Core % | Flame-Retardant % | | Oxygen Index | Arapahoe Smoke | Plate Scumming |
|---|---|---|---|---|---|---|---|
| 39C | A | 31 | STP | 7.1 | 39 | 1.09 | Yes |
| 40C | B | 24 | STP | 5.6 | 38 | 1.34 | Yes |
| 41C | A | 28 | SB | 3.2 | 38 | 1.82 | No |
| 42C | A | 27 | SB | 6.3 | 41 | 0.75 | No |
| 43C | B | 27 | SB | 6.2 | 41 | 1.50 | No |
| 44C | A | 30 | DOT | 3.4 | 39 | 1.54 | No |
| 45C | A | 30 | DOT | 6.9 | 43 | 1.62 | No |
| 46C | B | 29 | DOT | 6.7 | 42 | 1.55 | No |
| 47C | A | 30 | STP/BA | 3.5/3.5 | 41 | 1.56 | Yes |
| 48C | A | 30 | ZB | 3.4 | 36 | 1.25 | — |
| 49C | A | 28 | ZB | 6.4 | 37 | 1.68 | — |
| 50C | A | 29 | ZB/APP | 1.3/6.7 | 47 | 2.26 | — |
| 51C | A | 29 | ZB/APP | 6.7/1.3 | 40 | 2.37 | — |
| 52C | A | 28* | ADHP/BA | 3.2/3.2 | 40 | 1.22 | Yes |
| 53C | A | 28* | ADHP/OA | 6.4/1.3 | 48 | 2.15 | Yes |
| 54C | A | 28* | ADHP/STP | 3.2/3.2 | 40 | 2.55 | Yes |
| 55C | A | 28* | ADHP/STP/BA | 3.2/2/2 | 41 | 1.68 | Yes |
| 56C | A | 28* | ADHP/$CaCl_3$ | 6.4/2.0 | 45 | 2.37 | Yes |
| 57C | A | 27 | TCP | 2.7 | 36 | 2.59 | — |
| 58C | A | 27 | TCP/APP | 0.3/5.8 | 38 | 3.06 | — |
| 59C | A | 26 | TCP/APP | 0.6/5.4 | 43 | 2.74 | — |
| 60C | A | 28 | TCP/APP | 1.3/5.1 | 43 | 2.92 | — |

*estimated
STP = sodium tetraborate pentahydrate
SB = sodium borate product
OA = oxalic acid
ADHP = ammonium dihydrogen phosphate
BA = boric acid
ZB = zinc borate
TCP = trischloroethyl phosphonate
DOT = disodium octaborate tetrahydrite

EXAMPLES 62–70 (Comparative)

When disodium octaborate tetrahydrite (DOT) is used to replace boric acid, following the procedure of Example 1 and at higher concentrations than shown in Table IV, the results shown in Table V, are achieved.

TABLE V

| Example | DOT % | Oxygen Index |
|---|---|---|
| 62C | 20 | 43 |
| 63C | 20 | 44 |
| 64C | 25 | 48 |
| 65C | 30 | 54 |
| 66C | 30 | 49 |
| 67C | 10.5 | 44 |
| 68C | 12 | 46 |
| 69C | 8 | 41 |
| 70C | 8 | 44 |

This table again shows the inconsistency of DOT as a flame-retardant.

EXAMPLE 71C

When ammonium dihydrogen phosphate is substituted for the boric acid of Example 1, the Arapahoe Smoke is substantially always greater than 1.9.

EXAMPLES 72–74C

When aluminum trihydrate is employed in lieu of the boric acid of Example 1 at concentrations of (72C) 5%, (73C) 10% and (74C) 15%, the Oxygen Index values recorded are 34, 34 and 36, respectively.

EXAMPLES 75–77C

Replacement of the boric acid Example 1 by mixtures of antimony oxide with 5% DOT at concentrations of (75C) 1.25%, (76C) 2.5% and (77C) 5.0%, result in Oxygen Index values of 39.5, 40 and 42.5, respectively.

We claim:

1. A fire-retardant heat and pressure consolidated article comprising, (a) a monostichous layer of randomly oriented, substantially non-hydrogen bonded, cellulosic fibers from about 0.5 mm to 2.5 mm in average length, said layer being from about 0.25 mm to 2.25 mm thick and containing from about 20% to 35%, by weight, based on the total weight of fiber, resin and flame retardant in (a), of a thermoset resin and a flame-retarding amount (a) of boric acid or ammonium pentaborate.

2. An article in accordance with claim 1 containing, positioned atop said (a), (b) a thermost resin impregnated, decorative sheet.

3. An article in accordance with claim 2 containing, positioned atop said (b), (c) a thermoset resin impregnated alpha-cellulose transparent overlay sheet.

4. An article in accordance with claim 3 wherein the thermoset resin in (a) is a phenolic resin and the thermoset resin in (b) and (c) is a melamine/formaldehyde resin.

5. An article in accordance with claim 2 wherein the thermoset resin in (a) is a phenolic resin and the thermoset resin in (b) is a melamine/formaldehyde resin.

6. An article in accordance with claim 1 in which the flame-retardant is boric acid.

7. An article in accordance with claim 1 wherein the thermoset resin in (a) is a phenolic resin.

8. A method of producing the article of claim 1 which comprises, (1) defibrating cellulosic fibers to produce fibers of an average length of about 0.5 to 2.5 mm in the presence of air to thereby form an air-fiber stream, (2) incorporating into said air-fiber stream from about 20% to about 35%, by weight, based on the total weight of fiber and resin, of particles of a thermosetting resin and a flame-retarding amount of boric acid or ammonium pentaborate to thereby form an air-fiber-resin flame-retardant stream, (3) depositing the fibers, flame-retardant and resin from said air-fiber-resin flame-retardant stream onto a foraminous belt at a thickness ranging from about 5 to about 100 mm, (4) pre-consolidating the deposited fibers, flame retardant and resin to a thickness of from about 0.5–10.0 mm to form a pre-consolidated layer, (5) heat and pressure consolidating said pre-consolidated layer.

9. A method in accordance with claim 8 wherein said pre-consolidated layer is formed into a laminate assembly comprising, in superimposed relationship, (A) said pre-consolidated layer and (B) a thermosetting resin impregnated decorative sheet before conducting said step (5).

10. A method in accordance with claim 9 wherein said laminate assembly contains, atop said (B), (C) a thermosetting resin impregnated, alpha-cellulose overlay sheet.

11. A method in accordance with claim 8 wherein said thermosetting resin in said air-fiber-flame-retardant resin stream is a phenolic resin.

12. A method according to claim 8 wherein the flame-retardant is boric acid.

* * * * *